US005819696A

United States Patent [19]

Wada

[11] Patent Number: 5,819,696

[45] Date of Patent: Oct. 13, 1998

[54] AIR CLEANER DEVICE OF ENGINE

[75] Inventor: Manabu Wada, Shizuoka-ken, Japan

[73] Assignee: Suzuki Motor Corporation, Shizuoka-ken, Japan

[21] Appl. No.: 928,952

[22] Filed: Sep. 12, 1997

[30] Foreign Application Priority Data

Oct. 30, 1996 [JP] Japan ..... 8-304002
Dec. 9, 1996 [JP] Japan ..... 8-344618

[51] Int. Cl.[6] ..... F02M 35/10

[52] U.S. Cl. ..... 123/198 E; 55/419

[58] Field of Search ..... 123/198 E, 184.53; 55/419

[56] References Cited

U.S. PATENT DOCUMENTS

| | | | |
|---|---|---|---|
| 4,396,407 | 8/1983 | Reese | 55/419 |
| 4,634,457 | 1/1987 | Miyazaki et al. | 123/198 E |
| 4,783,207 | 11/1988 | Nagashima et al. | 123/198 E |
| 4,787,924 | 11/1988 | Nagashima et al. | 55/419 |
| 5,400,753 | 3/1995 | Andress et al. | 55/313 |
| 5,472,464 | 12/1995 | Mochida | 55/385.3 |
| 5,522,355 | 6/1996 | Uhl | 123/198 E |
| 5,582,146 | 12/1996 | Linsbauer et al. | 123/198 E |
| 5,632,243 | 5/1997 | Buchholz | 123/198 E |
| 5,655,497 | 8/1997 | Nakajima | 123/198 E |
| 5,706,777 | 1/1998 | Schlessmann et al. | 123/198 E |

*Primary Examiner*—David A. Okonsky
*Attorney, Agent, or Firm*—Flynn, Thiel, Boutell & Tanis, P.C.

[57] ABSTRACT

An air cleaner used regardless of a change in condition caused due to the presence/absence of an air valve, and thus it reduces the number of parts used, lowers the cost, and eliminates the requirement of changing the layout of peripheral parts of the air cleaner. One of an upper case and a lower case of the air cleaner has an intake port through which air is drawn into an internal space of the one case, and an integral partition wall is disposed near the intake port so as to isolate a portion of the internal space to form an extra space. The partition wall has a first surface facing the intake port and having a first opening formed therein, and a second surface facing the extra space and intersecting the first surface at an axis of intersection. The second surface has a second opening spaced from the axis of intersection by the same distance as the first opening is spaced from the axis of intersection. In another form of the invention, there is provided a partition wall disposed near the intake port and formed jointly by a wall portion partitioning the internal space, and a cover portion covering the wall portion so as to isolate a portion of the internal space to form an extra space. The partition wall has a first surface facing the intake port, and a second surface facing the extra space and intersecting the first wall at an acute angle defined between the first and second surfaces.

3 Claims, 7 Drawing Sheets

AIR CLEANER DEVICE OF ENGINE

FIELD OF THE INVENTION

This invention relates to an air cleaner device for an engine, and more particularly to an air cleaner device of the type wherein a single air cleaner can be always used regardless of whether or not an air valve is employed to meet the specifications and intended areas of use of the air cleaner device, and thus makes it possible to reduce the number of parts used, lower the cost and eliminate a possible change in layout of peripheral parts of an air valve.

BACKGROUND OF THE INVENTION

In the case of engines designed for use with a carburetor, air heated with engine heat (hereinafter referred to as "warm air") is drawn to prevent the occurrence of icing during operation of the engine in a cold season. Usually the outside air (hereinafter referred to as "cool air" or simply as "air") is drawn into the engines. In order to switch warm air and cool air, a valve, i.e. an air valve, must be disposed on an upstream side of an air cleaner. The air valve has two types: one being integral with the air cleaner, and the other separate from the air cleaner. In the case of air cleaners designed for use with a fuel injection system, the air valve is detached as it is almost unnecessary. The air valve can be removed according to intended areas of use.

An example of the foregoing air cleaner devices for engines is disclosed in Japanese Patent Laid-open Publication No. HEI 1-170754 ('754). A muffling device of an internal combustion engine disclosed in the '754 publication includes a resonance chamber connected in fluid communication with an intermediate portion of an intake passage of the engine via a first communicating portion, a second communicating portion communicating the resonance chamber with an air cleaner chamber, a third communicating portion communicating the resonance chamber with an air inlet of a secondary air supply device, and a selector valve for selectively making and blocking communication between the resonance chamber and the first communicating portion or between the resonance chamber and the second communicating portion. The resonance chamber is used as an original resonance chamber for attenuating intake noise and also as an expansion chamber for attenuating air suction noise, so that both intake noise and air suction noise can be lowered without requiring undue space.

In the conventional engine air cleaner device, as shown here in FIG. 13, an air cleaner 102 of the type having a separate air valve is formed jointly by an upper case 104, a lower case 106, and a filter element 108 housed inside the upper and lower cases 104, 106. The separate air valve 124 is disposed upstream of the air cleaner 102. The air valve 124 has two types: one being designed for general use, and the other for use in cold areas.

Accordingly, in the case of the air cleaner designed for use with a separate air valve as described above, two types of layout or arrangement must be provided, one for the air valve for general use and the other for the air valve used in the cold areas. As a result, the number of parts disposed in the vicinity of the air valve increases, the manufacture is rendered difficult to perform, and additional cost is incurred and thus poses a drawback in terms of economy. In addition, due to space required to meet two different mounting conditions, the air cleaner also has a drawback in terms of utility.

In the case of the air cleaner of the type having an integral air valve fused or welded to the outside of the air cleaner, two designs must be provided to deal with the presence and absence of the air valve. This means that if a common layout is employed, an unnecessary part or parts must be attached to the air cleaner. Alternatively, if a minimum number of parts are employed, two different layouts must be provided.

SUMMARY OF THE INVENTION

To eliminate the foregoing drawbacks, the present invention seeks to provide an air cleaner device of an engine, of the type including a filter element disposed inside an upper case and a lower case to form an air cleaner so that air drawn into said air cleaner is supplied to a carburetor, characterized in that one of the upper case and the lower case has an intake port through which air is drawn into an internal space of the one case, and a partition wall is formed integrally with the one case near the intake port so as to isolate a portion of the internal space to form an extra space, the partition wall having a first surface facing the intake port, a second surface facing the extra space and intersecting the first surface at an axis of intersection, a first opening formed in the first surface and spaced from the axis of intersection, and a second opening formed in the second surface at a position spaced from the axis of intersection by a distance substantially equal to a distance between the first opening and the axis of intersection.

The invention further seeks to provide an air cleaner device of an engine, of the type including a filter element disposed inside an upper case and a lower case to form an air cleaner so that air drawn into said air cleaner is supplied to a carburetor, characterized in that one of the upper case and the lower case has an intake port through which air is drawn into an internal space of the one case, and a partition wall disposed near the intake port and formed jointly by a wall portion partitioning the internal space, and a cover portion covering the wall portion so as to isolate a portion of the internal space to form an extra space, the partition wall having a first surface facing the intake port, a second surface facing the extra space and intersecting the first surface at an axis of intersection, with an acute angle being defined between the first and second surfaces, a first opening formed in the first surface and spaced from the axis of intersection, and a second opening formed in the second surface at a position spaced from said axis of intersection by a distance substantially equal to a distance between the first opening and the axis of intersection.

By the invention described above, when an air valve is employed, the extra space functions as an air valve chamber. The extra space functions also as a resonator chamber when the air valve is not employed. Thus, one and the same air cleaner always can be used regardless of where the air valve is employed and meet the specifications for the intended areas of use of the air cleaner. This arrangement makes it possible to reduce the number of parts used, lower the cost, and eliminate a possible change in layout of peripheral parts of the air cleaner.

When the air valve is employed, the extra space functions as an air valve chamber. The extra space functions also as a resonator chamber when the air valve is not employed. The first surface and the second surface intersect together at an acute angle defined therebetween so that the air valve has a relatively small range of rotation but can perform an accurate adjustment of the amount of flow of warm air and cool air. In addition, since a single air cleaner can be always used regardless of whether the air valve is employed or not to meet the specifications for the intended areas of use of the air cleaner, it is possible to reduce the number of parts used, lower the cost and eliminate a possible change in layout of peripheral parts of the air cleaner.

Other objects and purposes of the invention will be apparent to persons acquainted with apparatus of this general type upon reading the following specification and inspecting the accompanying drawings.

DETAILED DESCRIPTION

Figure 1:
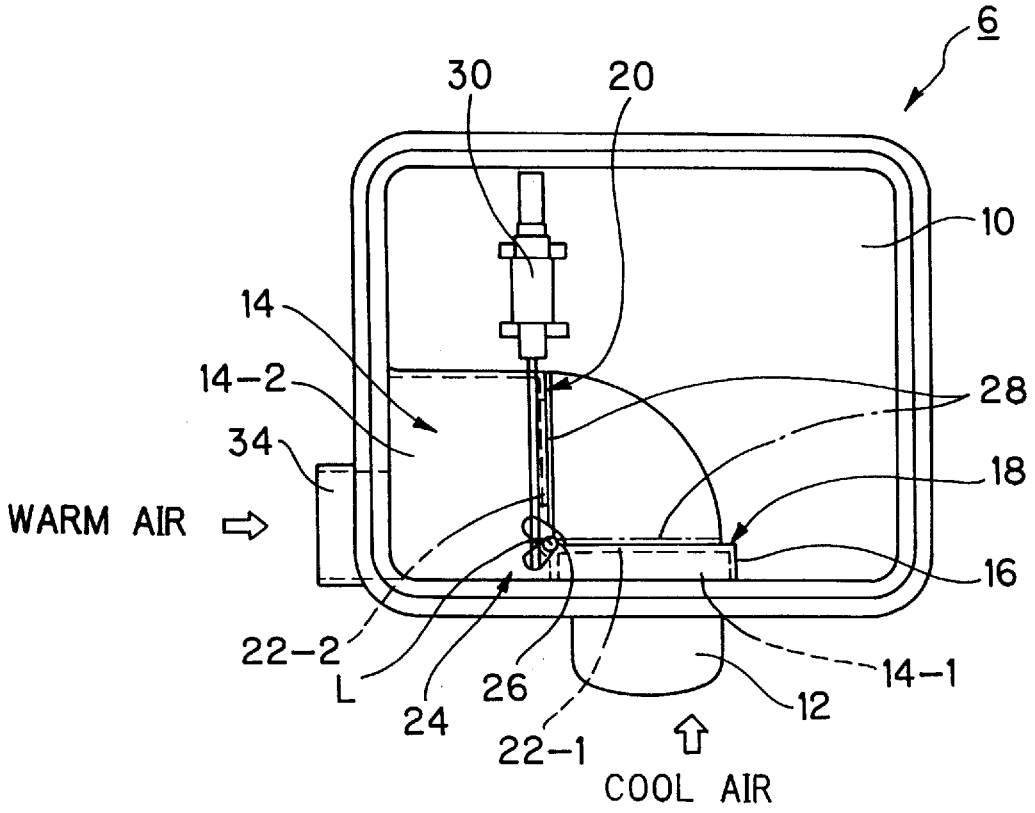
FIG. 1 is a plan view showing a lower case of an air cleaner for an engine having an air valve according to a first embodiment of the present invention.
Figure 2:
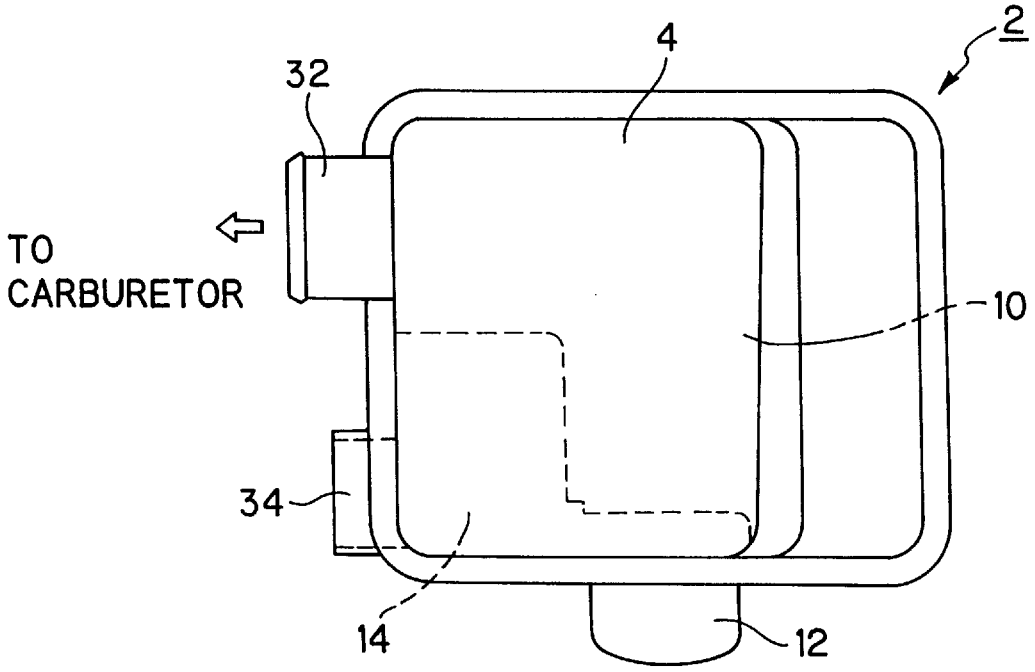
FIG. 2 is a plan view of the air cleaner incorporating therein the air valve.
Figure 3:
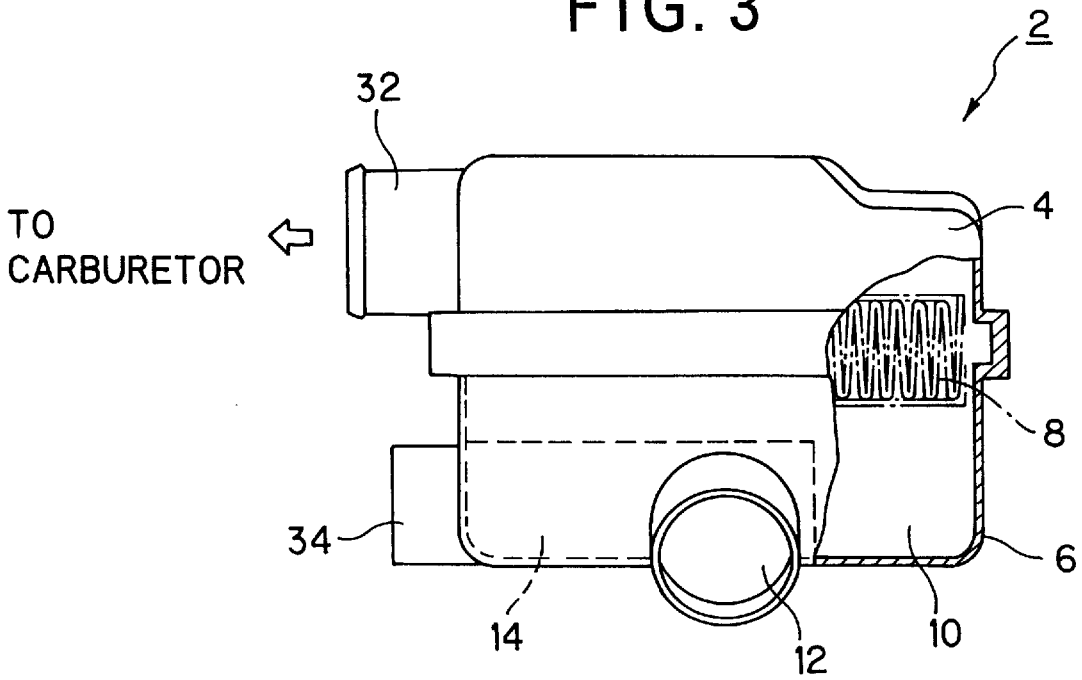
FIG. 3 is a front elevational view, with a portion broken away for clarity, of the air cleaner with the air valve disposed therein.
Figure 4:
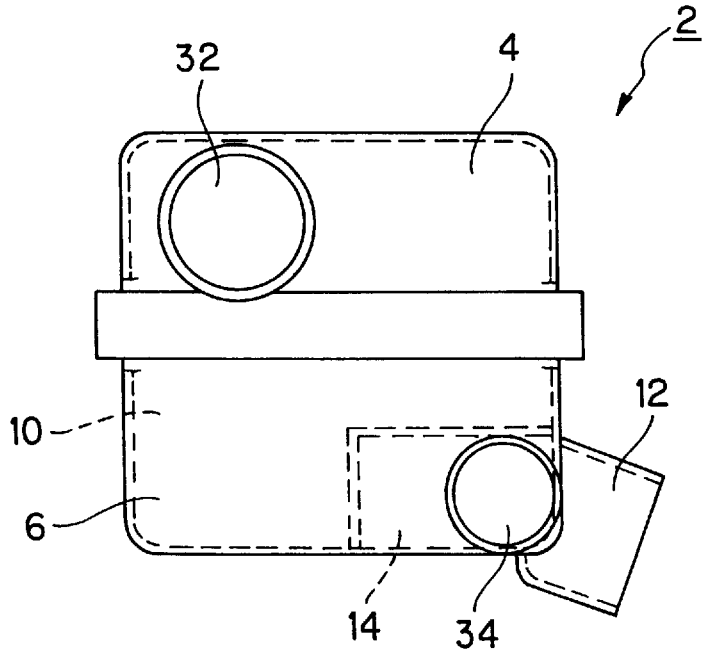
FIG. 4 is a left side view of the air cleaner having the air valve.
Figure 5:
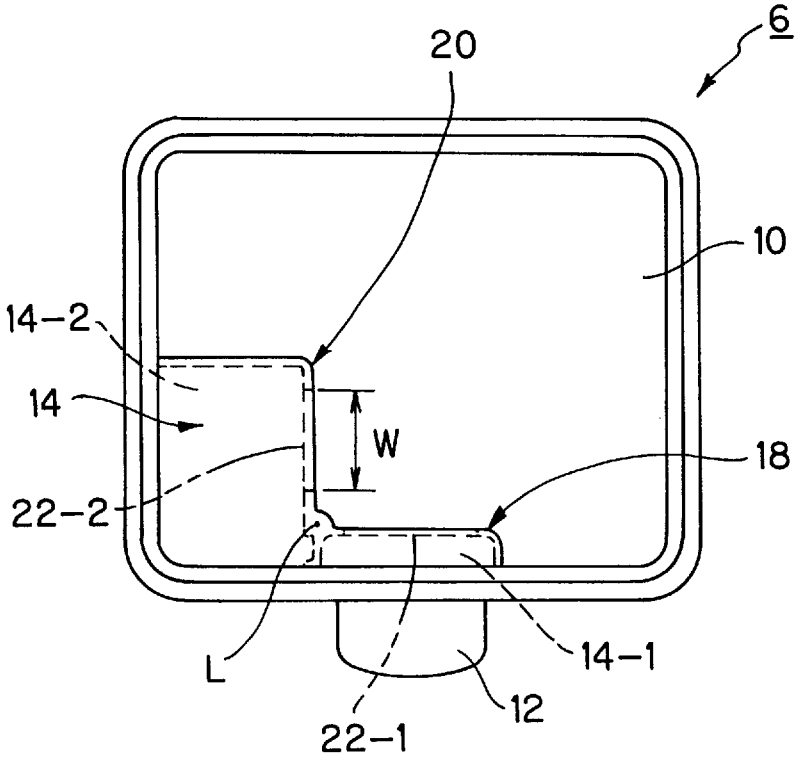
FIG. 5 is a plan view of a lower case with no air valve disposed therein.
Figure 6:
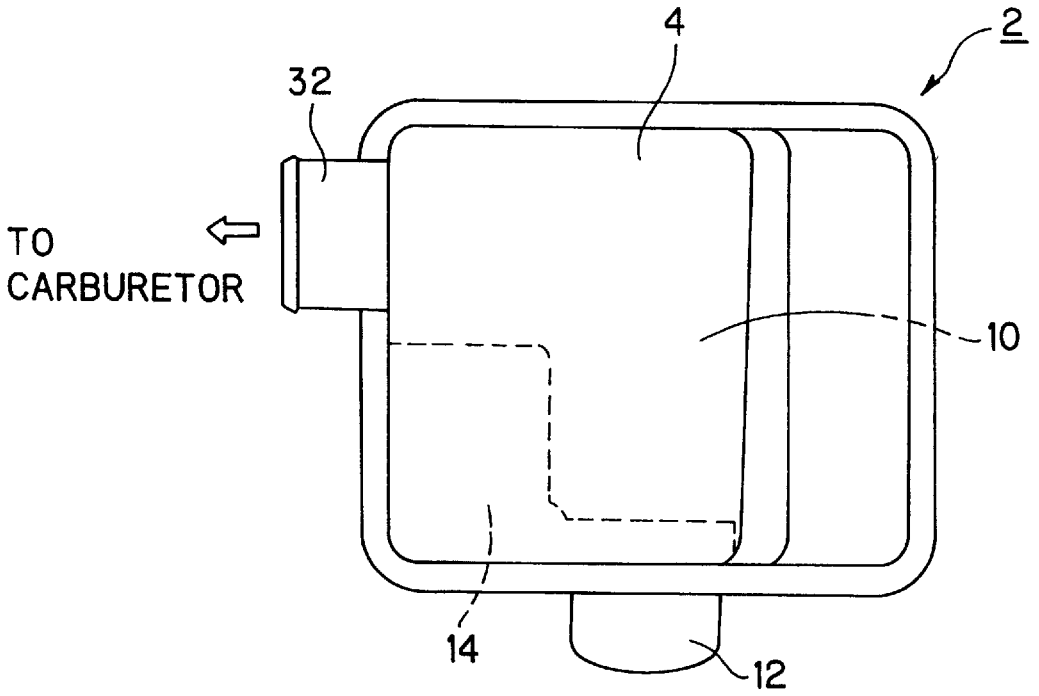
FIG. 6 is a plan view of an air cleaner with no air valve disposed therein.
Figure 7:
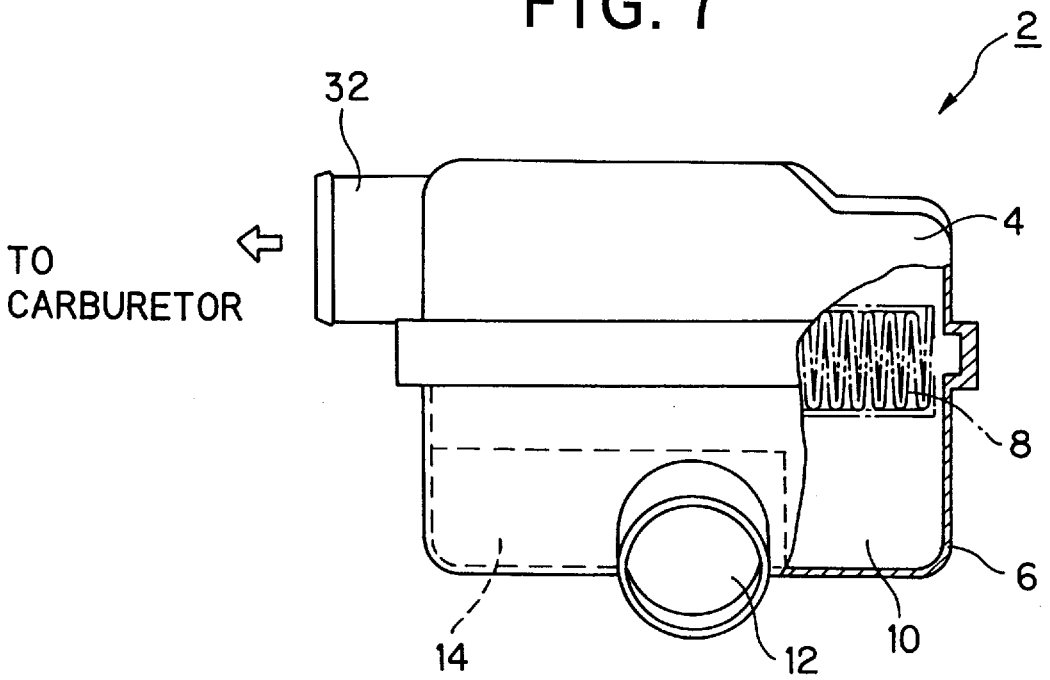
FIG. 7 is a front elevational view, with a portion broken away for clarity, of the air cleaner having no air valve.
Figure 8:
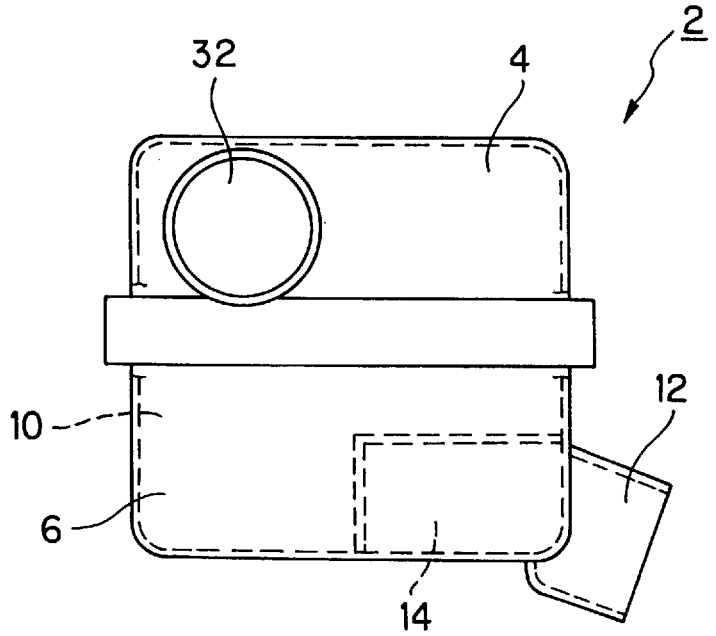
FIG. 8 is a left side view of the air cleaner with no air valve disposed therein.

Preferred embodiments of the present invention will be described in greater detail with reference to the accompanying drawings.

FIGS. 1 through 8 show a first embodiment of the present invention. In FIGS. 1–8, designed by 2 is an air cleaner, by 4 is an upper case, and by 6 is a lower case. The air cleaner 2 is formed jointly by an upper case 4, a lower case 6, and a filter element 8 disposed inside the upper and lower cases 4, 6 so that air drawn into the air cleaner 2 is supplied to a carburetor, not shown.

One of the upper case 4 and the lower case 6 of the air cleaner 2 has an intake hole or port 12 through which air can be drawn into an internal space 10 of the lower case 6, for example lower case 6 (FIG. 1). The lower case 6 further has a partition wall 16 formed integrally therewith near the intake port 12 so as to separate or isolate a portion of the internal space 10 to form or define an extra space 14. The partition wall 16 has a first surface 18 facing the intake port 12, and a second surface 20 facing the extra space 14 and intersecting the first surface 18 at a line L or axis of intersection. The partition wall 16 further has a first opening 22-1 formed in the first surface 18 and having a predetermined width W, and a second opening 22-2 of the predetermined width W formed in the second surface 20 at a position spaced from the line (axis of intersection) L by a distance equal to the distance between the axis of intersection L and the first opening 22-1.

More specifically, as shown in FIGS. 3 and 4 and FIGS. 7 and 8, the intake port 12 is formed such that air can be drawn into the lower case 6 diagonally from below at a front central portion (lower side in FIG. 1) of the lower case 6.

The partition wall 16, as shown in FIGS. 1–8, is fixed integrally to the lower case 6 and forms the extra space 14 having a substantially L shape which separates or isolates a portion of the internal space 10 of the lower case 6 extending around a front side (lower side in FIG. 1) including the intake port 12 and a front left corner (lower left side in FIG. 1) of the lower case 6. In this case, the extra space 14 is divided into a first extra space 14-1 on the first surface 18 side, and a second extra space 14-2 on the second surface 20 side. The first and second extra spaces 14-1, 14-2 are each formed as an independent space.

The second extra space 14-2 of the extra space 14 functions as a resonator chamber when an air valve 24 is not used or employed and also functions as an air valve chamber when the air valve 24 is employed.

The air valve 24 comprises a pivot shaft 26 and a flap-like valve body 28, and is driven by a valve switching means 30 to perform a change-over operation for opening and closing the first and second openings 22-1, 22-2. The pivot shaft 26 has a center of rotation forming an axis which is generally coaxial with the line L where the first surface 18 of the partition wall 16 located on the intake port 12 side crosses the second surface 20 of the partition wall 16 located on the second extra space 14-2 side of the extra space 14. However, a deviation not greater than the thickness of the flat-like valve body 28 is acceptable between the center of rotation of the pivot shaft 26 and the line L.

Reference numeral 32 denotes an air supply hole through-which air drawn in the air cleaner 2 is supplied to the non-illustrated carburetor. Designated by 34 is a warm air intake hole or inlet through which warm air can be drawn into the second extra space 14-2 of the extra space 14 when the air valve 24 is used.

Now, operation of the air cleaner device of FIGS. 1–8 will be described.

In the case where an air valve 24 is used, as shown in FIGS. 1 through 4, a pivot shaft 26 and a flap-like valve body 28 of the air valve 24 are disposed in the lower case 6, and a valve switching means 30 is disposed in the lower case 6 across the internal space 10. Then, a warm air inlet 34 is formed in the lower case 6 for introducing warm air into the second extra space 14-2 of the extra space 14. The second extra space 14-2 functions as an air valve chamber and hence is used as a warm air passage. In this case, the air valve 24 is driven by the valve switching means 30 to perform a change-over operation to open and close the first and second openings 22-1, 22-2 formed in the first and second surfaces 18, 20, respectively, so that while the air valve 24 is in use, the amount of flow of cool air entering through the intake port 12 serving as a cool air intake hole and the amount of flow of warm air entering through the warm air inlet 34 can be adjusted.

On the other hand, in the case where the air valve 24 is not employed, as shown in FIGS. 5–8, the lower case 6 has no air valve disposed therein, nor does it have a warm air inlet 34 formed therein. In this instance, the air drawn through the intake port 12 flows from the first extra space 14-1 of the extra space 14 into the internal space 10, and the second extra space 14-2 of the extra space 14 functions as a resonator chamber.

Thus, even when conditions change due to the presence/absence of the air valve 24 in view of the specifications and intended areas of use, the same air cleaner 2 can be used. It is therefore possible to reduce the number of parts used, lower the cost, and eliminate a possible layout change of peripheral parts of the air cleaner 2. Thus, the air cleaner is advantageous in terms of economy and also in terms of its utility.

Under the condition in which the air valve 24 is not employed, the second extra space 14-2 of the extra space 14 functions as a resonator chamber. Thus, a resonator effect can be expected.

On the other hand, under the condition in which the air valve 24 is employed, the second extra space 14-2 of the extra space 14 functions as an air valve chamber.

FIGS. 9 through 12 show a second embodiment of the present invention. In the second embodiment, these parts having the same function as those described in the first embodiment are designated by the same reference characters.

According to the features of the second embodiment, a partition wall 46 is provided, which includes a wall portion 42 dividing or partitioning an internal space 10, and a cover portion 44 covering the wall portion 42 so as to separate or isolate a portion of the internal space 10 to define or form an extra space 14. The partition wall 46 has a first surface 48 facing an intake port 12, and a second surface 50 facing the extra space 14 and crossing the second surface 50 with an acute angle defined between the first and second surfaces 48, 50.

More specifically, the air cleaner 2, as shown in FIGS. 9–12, is formed jointly by an upper case 4, a lower case 6, and a filter element (not shown) disposed inside the upper and lower cases 4, 6 so that air drawn into the air cleaner 2 is supplied to a carburetor, not shown.

One of the upper case 4 and the lower case 6 of the air cleaner 2 has an intake hole or port 12, for example the lower case 6, through which air can be drawn into an internal space 10 of the lower case 6. The lower case 6 further has a partition wall 46 disposed near the intake port 12 and formed jointly by a wall portion 42 partitioning the internal space 10, and a cover portion 44 covering the wall portion 42 so as to isolate a portion of the internal space 10 to form an extra space 14. The partition wall 46 has a first surface 48 facing the intake port 12, and a second surface 50 facing the extra space 14 and intersecting the first surface 48 at a line or an axis of intersection L. An acute angle is defined between the first and second surfaces 48, 50. The partition wall 46 further has a first opening 52-1 formed in the first surface 48 and having a predetermined width W, and a second opening 52-2 having the predetermined width W formed in the second surface 50 at a position spaced from the line (axis of intersection) L by a distance equal to the distance between the axis of intersection L and the first opening 52-1.

Stated in greater detail, as shown in FIGS. 3–4 and FIGS. 9–12, the intake port 12 is formed such that air can be drawn into the lower case 6 from a front central portion (lower side in FIG. 9) of the lower case 6.

The partition wall 46 is composed of the wall portion 42 which is upright, and the cover portion 44 which covers an upper part of the wall portion 42 so as to separate or isolate a portion of the internal space 14. The cover portion 44 is produced separately from the wall portion 42 in advance and is fixedly connected to the wall portion 42. As shown in FIGS. 9–12, the cover portion 44 is integrally connected to the lower case 6, for example, by fusing or welding, so as to isolate a portion of the internal space 10 extending around a front side (lower side in FIG. 9) of the lower case 6 including the intake port 12 and a front left corner (lower left side in FIG. 9) of the lower case 6, thereby forming the extra space 14 within the internal space 10 of the lower case 6. In this case, the extra space 14 is divided into a substantially triangular prism-like first extra space 14-1 on the first surface 48 side, and a substantially triangular prism-like second extra space 14-2 on the second surface 50 side. The first and second extra spaces 14-1, 14-2 are each formed as an independent space. The second extra space 14-2 of the extra space 14 functions as a resonator chamber when an air valve 24 is not used or employed and also functions as an air valve chamber when the air valve 24 is employed.

The air valve 24 comprises a pivot shaft 26 and a flap-like valve body 28, and is driven by a valve switching means 30 to perform a change-over operation for opening and closing the first and second openings 52-1, 52-2. The first opening 52-1 is formed merely by casting, for example. In the same manner as the second opening 52-2 shown in FIG. 9, the first opening 52-1 may be formed in a partition disposed at a position where the first opening 52-1 is to be formed. The pivot shaft 26 has a center of rotation forming an axis which is substantially coaxial with the line L where the first surface 48 of the partition wall 46 located on the intake port 12 side crosses the second surface 50 of the partition wall 46 located on the second extra space 14-2 side.

As in the first embodiment described above, reference numeral 32 denotes an air supply hole through which air drawn in the air cleaner 2 is supplied to the non-illustrated carburetor. Designated by 34 is a warm air intake hole or inlet through which warm air can be drawn into the second extra space 14-2 of the extra space 14 when the air valve 24 is used. Designated by 56 are mounting flanges, by 58 are bushings, and by 50 are collars.

Figure 9:
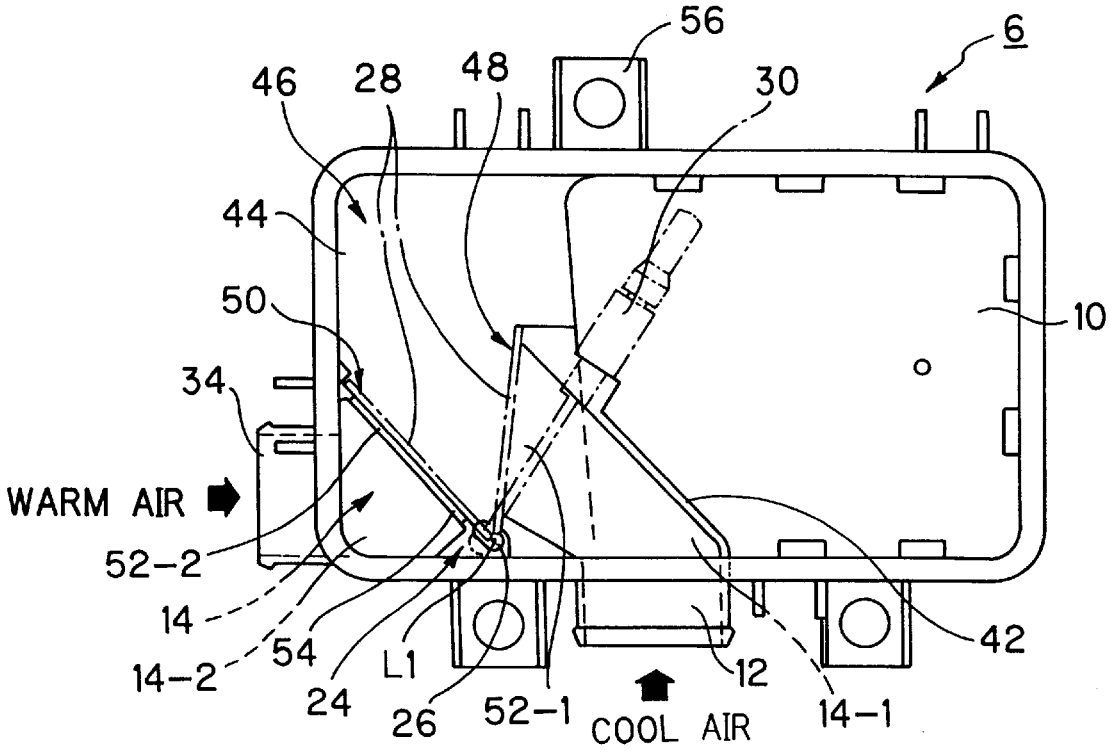
FIG. 9 is a plan view of a lower case of an air cleaner for an engine with an air valve disposed therein according to a second embodiment of the present invention.
Figure 10:
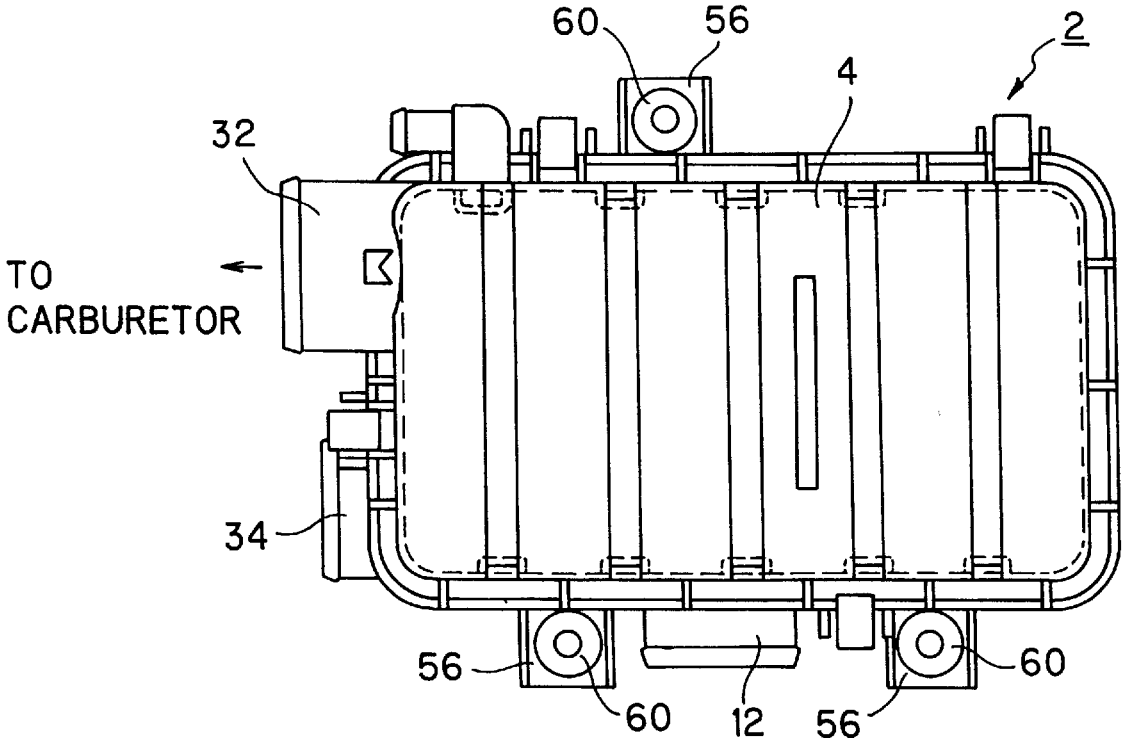
FIG. 10 is a plan view of the FIG. 9 air cleaner with the air valve disposed therein.
Figure 11:
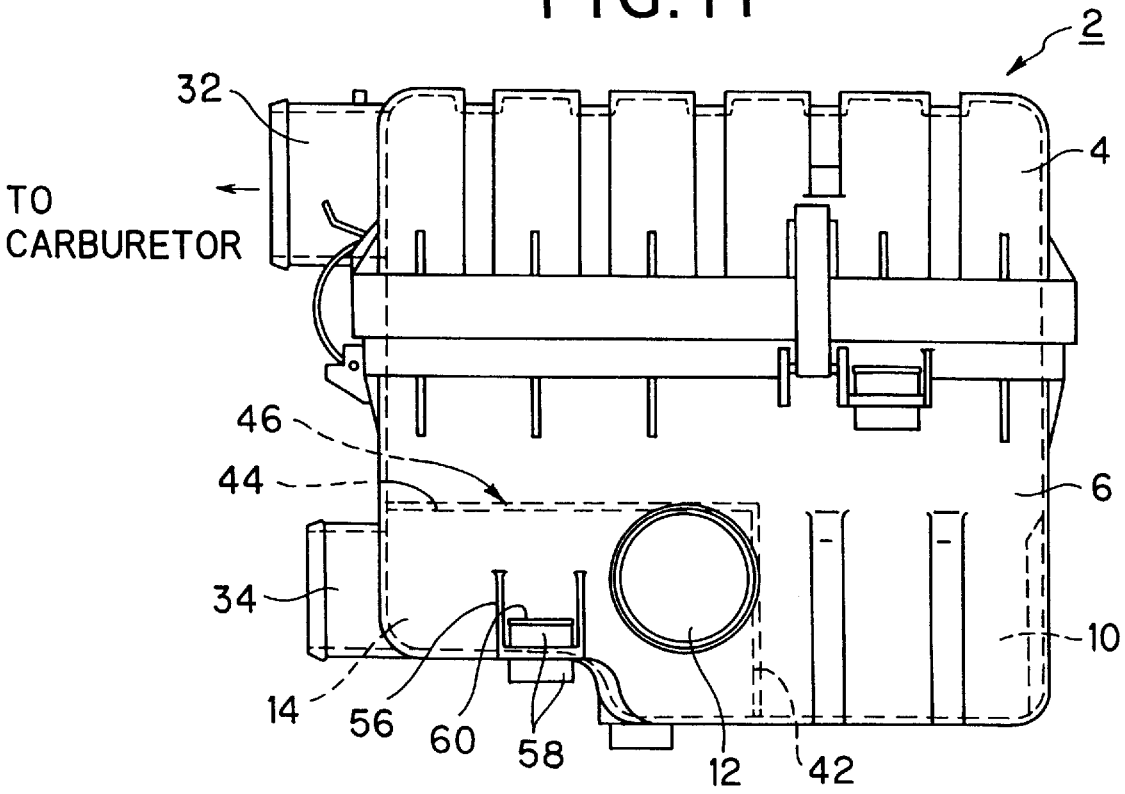
FIG. 11 is a front elevational view of the FIG. 9 air cleaner with the air valve disposed therein.
Figure 12:
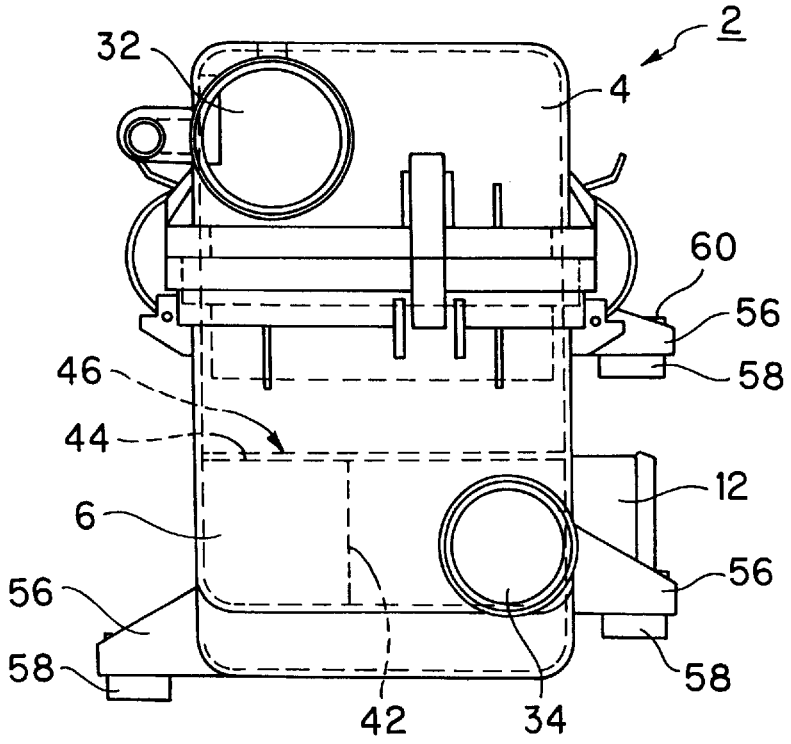
FIG. 12 is a left side view of the FIG. 9 air cleaner with the air valve disposed therein.
Figure 13:
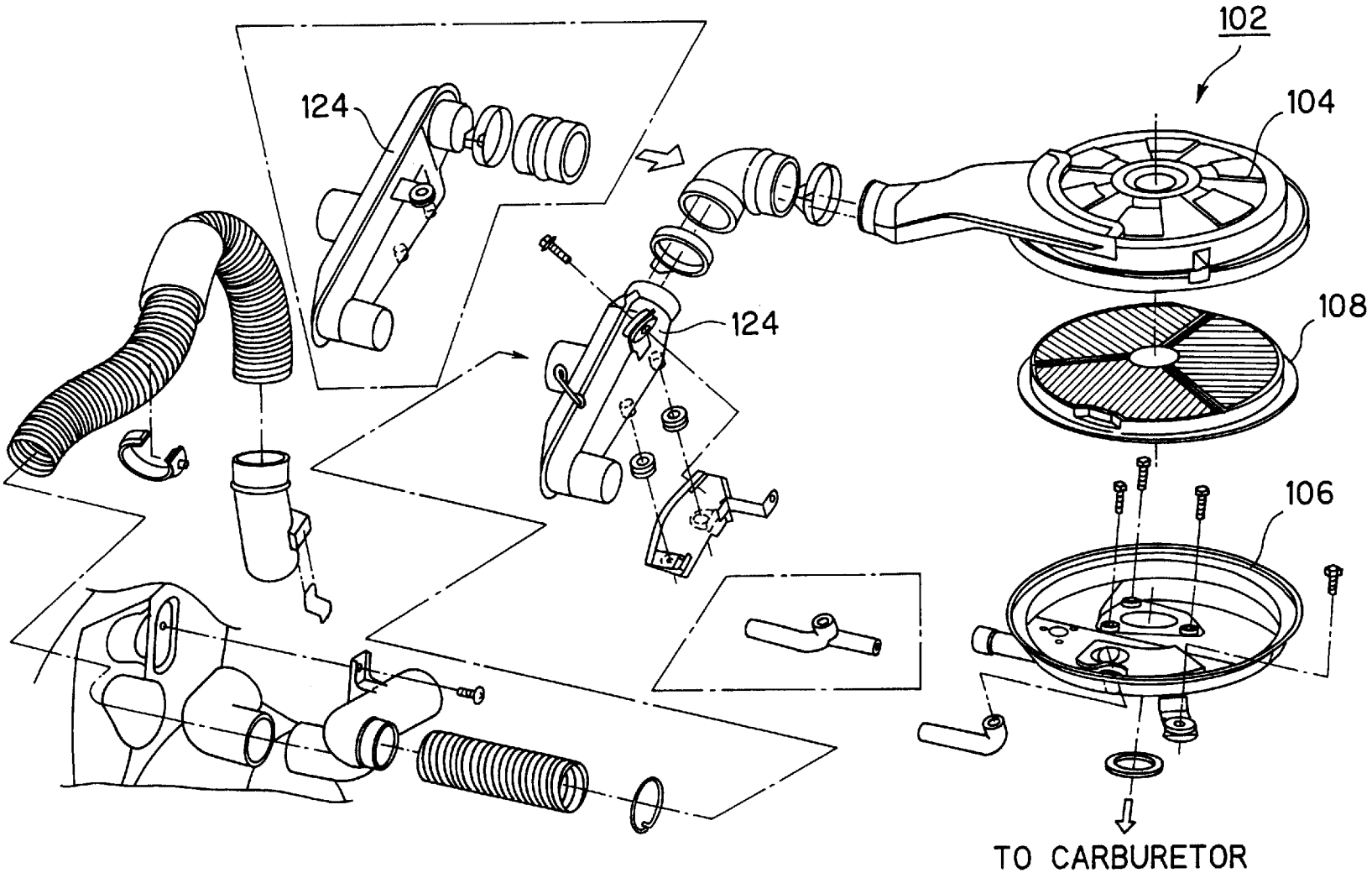
FIG. 13 is an exploded view illustrative of the manner in which a conventional air cleaner of the type having a separate air valve is mounted together.

In the case where an air valve 24 is used, as shown in FIG. 9, a pivot shaft 26 and a flap-like valve body 28 of the air valve 24 are disposed in the lower case 6, and a valve switching means 30 is disposed in the lower case 6 across the internal space 10. Then, a warm air inlet 34 is formed in the lower case 6 for introducing warm air into the second extra space 14-2 of the extra space 14. The second extra space 14-2 functions as an air valve chamber and hence is used as a warm air passage. In this case, the air valve 24 is driven by the valve switching means 30 to perform a change-over operation to open and close the first and second openings 52-1, 52-2 formed in the first and second surfaces 18, 20, respectively, so that while the air valve 24 is in use, the amount of flow of cool air entering through the intake port 12 serving as a cool air intake hole and the amount of flow of warm air entering through the warm air inlet 34 can be adjusted.

On the other hand, in the case where the air valve 24 is not employed, the lower case 6 has no air valve 24 disposed therein, nor does it have a warm air inlet 34 formed therein. In this instance, the air drawn through the intake port 12 flows from the first extra space 14-1 of the extra space 14 into the internal space 10, and the second extra space 14-2 of the extra space 14 functions as a resonator chamber.

By virtue of the first and second surfaces 48, 50 intersecting together with an acute angle defined therebetween, the flap-like valve body 28 of the air valve 24 has a relatively small range of rotation and, hence, is able to perform its change-over operation rapidly and thus enables the air valve 2 to perform an accurate adjustment of the flow quantity of warm air and cool air.

Thus, even when conditions change due to the presence/absence of the air valve 24 in view of the specifications and intended areas of use, the same air cleaner 2 can be used in the same manner as the fist embodiment. It is therefore possible to reduce the number of parts used, lower the cost, and eliminate a possible layout change of peripheral parts of the air cleaner 2. Thus, the air cleaner device is advantageous in terms of economy and also in terms of utility.

Under the condition in which the air valve 24 is not employed, the second extra space 14-2 of the extra space 14 functions as a resonator chamber in the same manner as the first embodiment. Thus, a resonator effect can be expected. On the other hand, under the condition in which the air valve 24 is employed, the second extra space 14-2 of the extra space 14 functions as an air valve chamber.

As described above in greater detail, according to the present invention, there is provided an air cleaner device of an engine, of the type including a filter element disposed inside an upper case and a lower case to form an air cleaner so that air drawn into the air cleaner is supplied to a carburetor. One of the upper case and the lower case has an intake port through which air is drawn into an internal space of the one case. A partition wall is formed integrally with one case near the intake port so as to isolate a portion of the internal space to form an extra space, the partition wall having a first surface facing the intake port, a second surface facing the extra space and intersecting the first surface at an axis of intersection. A first opening is formed in the first surface and spaced from the axis of intersection. A second opening is form in the second surface at a position spaced from the axis of intersection by a distance substantially equal to a distance between the first opening and the axis of intersection. With this arrangement, even when conditions change due to the presence/absence of the air valve employed in view of the operating specifications and intended areas of use, the same air cleaner can be used. It is, therefore, possible to reduce the number of parts used, lower the cost, and eliminate a possible change in layout of peripheral parts of the air cleaner. Accordingly, the air cleaner device is advantageous in terms of economy and also in terms of utility.

An air cleaner device of an engine provided according to a modified form of the invention is of the type including a filter element disposed inside an upper case and a lower case to form an air cleaner so that air drawn into the air cleaner is supplied to a carburetor. One of the upper case and the lower case has an intake port through which air is drawn into an internal space of the one case. A partition wall is disposed near the intake port and formed jointly by a wall portion partitioning the internal space. A cover portion covers the wall portion so as to isolate a portion of the internal space to form an extra space, the partition wall having a first surface facing the intake port, a second surface facing the extra space and intersecting the first surface at an axis of intersection. An acute angle is defined between said first and second surfaces. A first opening is formed in the first surface and spaced from the axis of intersection. A second opening formed in the second surface at a position spaced from the axis of intersection by a distance substantially equal to a distance between the first opening and the axis of intersection. By virtue of the first and second surfaces intersecting together with an acute angle defined therebetween, the air valve is able to perform its change-over operation rapidly and thus insures an accurate adjustment of the flow quantity of warm air and cool air. In addition, since the same air cleaner can be used even when conditions change due to the presence/absence of the air valve in view of the operating specifications and intended areas of use, it is possible to reduce the number of parts used, lower the cost, and eliminate a possible layout change of peripheral parts of the air cleaner. Thus, the air cleaner device is advantageous in terms of economy and also in terms of utility.

Under the condition in which the air valve 24 is not employed, the second extra space 14-2 of the extra space 14 functions as a resonator chamber in the same manner as the first embodiment. Thus, a resonator effect can be expected. On the other hand, under the condition in which the air valve 24 is employed, the second extra space 14-2 of the extra space 14 functions as an air valve chamber.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An air cleaner device of an engine, of the type including a filter element disposed inside an upper case and a lower case to form an air cleaner so that air drawn into said air cleaner is supplied to a carburetor, the improvement comprising one of said upper case and said lower case having an intake port through which air is drawn into an internal space of said one case, and a partition wall formed integrally with said one case near said intake port so as to isolate a portion of said internal space to form an extra space, said partition wall having a first surface facing said intake port, a second surface facing said extra space and intersecting said first surface at an axis of intersection, a first opening formed in said first surface and spaced from said axis of intersection, and a second opening formed in said second surface at a position spaced from said axis of intersection by a distance substantially equal to a distance between said first opening and said axis of intersection.

2. The air cleaner device of the engine according to claim 1, wherein said extra space functions as a resonator chamber when an air valve is not employed and also functions as an air valve chamber when the air valve is employed.

3. An air cleaner device of an engine, of the type including a filter element disposed inside an upper case and a lower case to form an air cleaner so that air drawn into said air cleaner is supplied to a carburetor, the improvement comprising one of said upper case and said lower case having an intake port through which air is drawn into an internal space of said one case, and a partition wall disposed near said intake port and formed jointly by a wall portion partitioning said internal space and a cover portion covering said wall portion so as to isolate a portion of said internal space to form an extra space, said partition wall having a first surface facing said intake port, a second surface facing said extra space and intersecting said first surface at an axis of intersection, an acute angle being defined between said first and second surfaces, a first opening formed in said first surface and spaced from said axis of intersection, and a second opening formed in said second surface at a position spaced from said axis of intersection by a distance substantially equal to a distance between said first opening and said axis of intersection.

* * * * *